US009410384B2

(12) United States Patent
Holen

(10) Patent No.: US 9,410,384 B2
(45) Date of Patent: Aug. 9, 2016

(54) CENTRING MEANS IN A ROTARY TONG

(75) Inventor: Bernt Olav Holen, Mandal (NO)

(73) Assignee: AKER MH AS, Kristiansand (NO)

( * ) Notice: Subject to any disclaimer, the term of this patent is extended or adjusted under 35 U.S.C. 154(b) by 1198 days.

(21) Appl. No.: 13/382,477

(22) PCT Filed: Jul. 6, 2010

(86) PCT No.: PCT/NO2010/000269
§ 371 (c)(1),
(2), (4) Date: Jan. 19, 2012

(87) PCT Pub. No.: WO2011/005111
PCT Pub. Date: Jan. 13, 2011

(65) Prior Publication Data

US 2012/0111154 A1 May 10, 2012

(30) Foreign Application Priority Data

Jul. 6, 2009 (NO) ..... 20092553
Jul. 6, 2009 (NO) ..... 20092554

(51) Int. Cl.
*B25B 17/00* (2006.01)
*E21B 19/16* (2006.01)
*E21B 19/24* (2006.01)

(52) U.S. Cl.
CPC ..... *E21B 19/163* (2013.01); *E21B 19/24* (2013.01)

(58) Field of Classification Search
CPC ..... E21B 19/163; E21B 19/24
USPC ..... 81/57–57.39
See application file for complete search history.

(56) References Cited

U.S. PATENT DOCUMENTS 2,879,680 A * 3/1959 Beeman ..... E21B 19/164 81/57.18
3,691,875 A * 9/1972 Geczy ..... E21B 19/164 81/57.14
3,780,815 A * 12/1973 Barron ..... E21B 19/165 166/77.51
4,649,777 A 3/1987 Buck
4,727,781 A * 3/1988 Yuehui ..... E21B 19/163 81/57.19
4,811,635 A * 3/1989 Falgout, Sr. ..... E21B 19/164 81/57.19
5,054,550 A * 10/1991 Hodge ..... E21B 19/168 166/78.1
8,109,179 B2 * 2/2012 Richardson ..... E21B 19/164 81/16
2003/0226248 A1 12/2003 McGuffin et al.
2005/0188794 A1 9/2005 Schulze-Beckinghausen

FOREIGN PATENT DOCUMENTS

CN 85 1 03021 A 7/1986
DE 198 25 174 A1 12/1999
GB 2 413 516 A 11/2005

* cited by examiner

*Primary Examiner* — Hadi Shakeri
*Assistant Examiner* — Danny Hong
(74) *Attorney, Agent, or Firm* — Birch, Stewart, Kolasch & Birch, LLP

(57) ABSTRACT

The invention relates to a pipe clamping device comprising a housing which has a tubular center in which a pipe is to be positioned. The pipe clamping device comprises at least three gripping devices for synchronous movement in towards the pipe. Each gripping device is disposed with a direction of movement in towards the tubular center, where each gripping device is arranged in order, in contact with the pipe, to provide a holding force. The pipe clamping device is provided with elongate flexible transmission elements, each of the elongate flexible transmission elements being attached to one of the gripping devices and running in contact with at least one support means to attachment to each of the other gripping devices. Upon movement of at least one of the gripping device, this movement is transmitted to at least one of the other gripping device by the associated elongate transmission element. The invention also comprises a pipe clamping device in which there is used at least two gripping devices and a torque tong, of which the pipe clamping device is a part.

24 Claims, 10 Drawing Sheets

CENTRING MEANS IN A ROTARY TONG

The invention relates to a pipe clamping device having a tubular centre in which a pipe is to be positioned, a torque tong (Norwegian, momenttang) for rotating and holding a pipe, according to the preamble of independent claim 1, and to a torque tong for rotating and holding a pipe, where the holding function is provided by a pipe clamping device according to independent claim 1.

BACKGROUND OF THE INVENTION

When assembling or dismantling pipe strings that are run into or down to a subterranean well, for example, for the recovery of oil it is usual to use so-called power tongs or torque tongs to connect or disconnect lengths of pipe from the pipe string. A common configuration is that an upper pipe section is manoeuvred and held by a gripping device, whilst a pipe section located below is rotated by means of a rotary torque tong. Another configuration is that the pipe string is held by a first power tong and/or by slips in the drill floor, whilst a rotary torque tong rotates a pipe member thereabove with the necessary torque. The rotary torque tong is equipped with gripping jaws (Norwegian gripebakker) for holding the pipe centrally in the tong so that when the torque tong rotates, the pipe member will also rotate about its longitudinal axis. It is an advantage if the rotational axis of the torque tong and the axial axis/longitudinal axis of the pipe member are positioned so as to be essentially coincidental.

In connection with the development of new torque tongs there has arisen a need to develop a pipe clamping device which ensures that the torque tong turns about a centre. It is also desirable that this pipe clamping device should be capable of being integrated as a part of the torque tong, although it can also be used separately from the torque tong. A person of skill in the art will also understand that the pipe clamping device will be capable of being used together with other types of equipment for connecting a pipe section to a pipe string than that explicitly mentioned here.

Pipe clamping devices according to the prior art often use hydraulically operated gripping devices that position and hold the pipe for engagement with the torque tong. It has proven to be difficult to obtain a precise arrangement where gripping devices are simultaneously brought to the tubular centre for centring the pipe in such a way that the torque tong is assured rotation about the tubular centre. A problem associated with the control of the gripping devices is that it is difficult to obtain good control of the positioning of hydraulically controlled gripping devices, without the use of sensors and monitoring systems. The use of sensors and monitoring systems results in a complex control system, and therefore there has arisen a need to produce a simple synchronising mechanism for the gripping devices that is based on mechanical principles.

Since the forces that act when the gripping devices grip about the pipe are extremely large, it is important that the pipe clamping device is provided such that damage is prevented in the event that not all the gripping devices are in contact when the system is actuated for the exertion of force of the gripping devices against the pipe wall. In the case where the pipe clamping device comprises three gripping devices, a situation may arise in which two of the gripping devices are brought into contact with the pipe, whilst the third device is not in contact with the pipe wall when the gripping device is activated to exert holding force against the pipe. In such a case, extremely large forces are at work in the system, and in the worst case this can result in breakdown of the pipe clamping device. There is therefore a need to adapt the pipe clamping device in such a way that the forces exerted by the gripping device that is not in contact with the pipe are taken up by the arrangement of the pipe clamping device. This is achieved in that the pipe clamping device is provided with a synchronisation system which is not self-destructive.

Furthermore, the pipe clamping device may be provided with a system to detect whether the gripping devices grip a pipe which is located outside a tolerance zone that is defined for the tubular centre of the pipe clamping device, in that the arrangement can be provided with switches that are capable of interrupting the sequence if the pipe lies outside the tolerance zone.

In addition to the invention having its natural use in oil-related operations, and in particular in connection with the joining of pipe lengths that are to be used in drilling-related operations, for example, drill pipes, drill collars and casings, the invention will also be useful in applications where it is necessary to obtain a positioning and holding of a pipe within a particular positioning area.

SUMMARY OF THE INVENTION

The object of the invention is to eliminate or reduce at least one of the drawbacks of the prior art.

This object is achieved according to the invention by the features described in the description below and in the claims that follow.

The pipe clamping device according to the invention comprises a housing which has a tubular centre in which a pipe is to be positioned. The pipe clamping device comprises at least three gripping devices, each disposed with a direction of movement towards the tubular centre, where each gripping device is arranged in order, in contact with the pipe, to provide a holding force. The gripping devices are arranged to move synchronously or simultaneously towards the pipe with the aid of elongate flexible transmission elements. Each elongate flexible transmission element is attached to one of the gripping devices and runs in contact with at least one support means to attachment with each of the other gripping devices. Upon movement of at least one of the gripping devices, this movement is transmitted to each of the other gripping devices by the associated elongate transmission element. Upon movement of at least one of the gripping devices, this movement is transmitted to each of the other gripping devices by the associated elongate transmission element. The at least one support means is connected to the at least one safety device for controlled displacement of this support means. The number of safety devices used for the invention depends on the number of support means with which the pipe clamping device is equipped and on how the arrangement is configured. In some embodiments of the pipe clamping device, a selection of the support means are equipped with safety devices and in other embodiments all the support means are equipped with safety devices.

By arranging the safety devices so as to obtain controlled displacement of the individual support means, an elasticity is provided in the pipe clamping device which means that damage to the pipe clamping device is prevented in the event that a pipe becomes jammed between two of the gripping devices.

In an embodiment of the invention, each safety device has a portion that is fastened to the pipe clamping device housing, whilst another portion of the safety device will be fastened to the support means.

The safety device may be constituted of means that can be arranged to have a pre-defined resistance to movement, the safety device being capable of being arranged so that it can exert motion when the pre-defined resistance to movement is overcome. The safety device will also be arranged so that it can move the support means back to its starting position after movement has been made.

The safety device may be constituted of a compressible elastic means. The stiffness of the elastic means may constitute the safety device's resistance to movement. Movement of the support means will be provided by compression or extension of the elastic means, whilst the return movement back to the support means starting position is then provided by the opposite motion, extension or compression, respectively. The starting position will preferably be a position in which the elastic means is unloaded.

It should be mentioned here that the safety device may comprise a spring means that is constituted of one or more springs. In another embodiment, the safety device may comprise a pressure-controlled piston cylinder.

The invention also comprises a detection means which is used to detect whether a pipe is positioned outside the tolerance zone of the tubular centre. The at least one support means is connected to at least one safety device, the at least one safety device being provided with a sensor device adapted to detect displacement of the support means. The sensor device may be connected to a switch that can be arranged to interrupt the movement of the gripping device, if movement that deviates from the normal movement pattern of the gripping devices is detected.

Furthermore, the invention comprises a safety device that supports at least one support means. At least one elongate flexible transmission element runs over the at least one support means. The elongate flexible transmission element connects a first and a second gripping device and transmits movement between them. The safety device is arranged so as to allow the support means it supports to be displaced controllably if movement of one of the gripping devices is prevented. Upon movement of one of the gripping devices, this movement is transmitted to the other gripping device by the elongate flexible transmission element. In one embodiment, two elongate flexible transmission elements may be used, each of which runs in contact with at least one support means. Furthermore, each flexible elongate transmission element can run in contact with two support means in the same way as described in connection with the embodiment in which three gripping devices are used.

In the case where the pipe clamping device comprises three gripping devices, an elongate flexible transmission element which runs in contact with at least one support means may have one end attached to a first gripping device and the other end attached to the second gripping device. Furthermore, a second elongate flexible transmission element that runs in contact with at least one support means may have one end attached to a first gripping device and the other end attached to the third gripping device. If the pipe clamping device is adapted so that the first gripping device moves in towards the tubular centre first, this movement will then be transmitted to the second and third gripping device by the attached elongate flexible transmission elements. In another instance, the pipe clamping device may be adapted in such a way that second and third gripping device move in towards the tubular centre first, the pipe clamping device then being arranged so that movement from second and third gripping device is transmitted to the first gripping device by the attached elongate flexible transmission elements.

The movement of the at least one gripping device can be transmitted by the elongate flexible transmission elements as a pulling force to each of the other gripping devices.

In one embodiment of the pipe clamping device, a set of elongate flexible transmission elements is provided, each set comprising two elongate flexible transmission elements, each of which runs in contact with at least one support means, the elongate flexible transmission elements in each set having one end attached to one of the gripping device and the other end attached to each of the other gripping devices. In the case where the pipe clamping device comprises three gripping devices, two elongate flexible transmission elements are fastened between the first and second gripping devices and two elongate flexible transmission elements are fastened between the first and third gripping devices. In such an embodiment, an arrangement is provided for reciprocal transmission of movement between the gripping devices. That is to say that the movement of the first gripping device is transmitted to the second and third gripping device and the movement of the second and third gripping device are transmitted to the first gripping device for correction of different movement pattern in towards the tubular centre.

The elongate flexible transmission element can be given a change of direction by contact with the at least one support means, thereby giving the elongate flexible transmission element a movement for transmission to each of the other gripping devices (or gripping device) with a movement component that is oppositely directed to the movement of the gripping device or gripping devices from which the movement is transmitted According to an embodiment of the invention, at least one of the elongate flexible transmission elements runs from one of the gripping devices and in contact with two support means, the first and second support means respectively, before attachment to each of the other gripping devices.

The at least one support means, for example, the first or second support means, may be arranged so that the run-out direction of the elongate flexible transmission element from this support means is oppositely directed to the run-in direction towards this support means.

The at least one support means, for example, the first or second support means, may be arranged to position the end portion of each belt towards attachment to the gripping devices.

In the case where first and second support means are used and the first support means is disposed in such a way that the run-out direction of the elongate flexible transmission element is oriented with a direction that is opposite to its run-in direction, the second support means will be adapted to position the end portion towards attachment to the gripping devices for effective transmission of movement to each of the gripping devices. As one of skill in the art will understand, the arrangement may also be disposed in such a way that the first and second support means have the opposite function.

Each of the gripping devices may be equipped with means for providing movement in towards the tubular centre and generating holding power in contact with the pipe. In an embodiment where three gripping devices are used, the first gripping device may be disposed such that it is activated first, and when the first gripping device reaches a pre-determined pressure level, the two other gripping devices will be pressurised. In another embodiment, the second and third gripping devices may be provided so that they are activated first, and when these gripping devices reach a predetermined pressure level, the first gripping device will be pressurised. In the case where two chains are to be used between respectively the first and second/third gripping device, all the gripping devices can be arranged so that they are actuated simultaneously.

The gripping devices can be actuated in different ways, but in one embodiment force-providing means are used such as linear actuators, preferably pressurised piston devices where hydraulics or pneumatics are used as control medium.

The at least one support means, for example, the first or second support means, may be positioned such that a movement component of the elongate flexible transmission element's movement, or the movement of the elongate flexible transmission element, is transmitted to the gripping device or each of the other gripping devices in a direction that is coincidental with the direction of movement thereof.

The tubular centre may be configured as an opening that is connected to an insertion portion for inserting the pipe. Alternatively, the pipe clamping device can be produced without the opening being connected to an insertion portion, the pipe clamping device according to this embodiment being suitable for permanent mounting around the pipe.

The axial axis of the pipe in the centre area may be oriented perpendicular to the radial plane of the pipe clamping device, for example, the central axis of the pipe clamping device can be oriented coincidental with the central axis of the pipe clamping device.

The gripping devices may have a direction of movement in the radial direction of the pipe clamping device, the gripping device being moved in a radial direction in towards the pipe.

The at least one, for example, first/second support means, may be provided as a roller means. The elongate flexible transmission elements may be provided as chains.

The pipe clamping device according to the invention as described above, may also function in that at least two gripping device are used. Like the pipe clamping device as described above, it comprises a housing which has a tubular centre in which a pipe is to be positioned. The pipe clamping device thus comprises at least two gripping devices for synchronous movement in towards the pipe. Each gripping device is disposed with a direction of movement in towards the tubular centre and is arranged in order, in contact with the pipe, to provide a holding force. Furthermore, the pipe clamping device is provided with at least one elongate flexible transmission element. The elongate flexible transmission element has one end attached to one of the gripping devices and runs in contact with at least one support means to attachment to the other gripping device. Upon movement of one of the gripping devices, this movement is transmitted to the other gripping device by the elongate flexible transmission element. In one embodiment, two elongate flexible transmission elements can be used, each of which runs in contact with at least one support means.

Furthermore, each flexible elongate transmission element can run in contact with two support means in the same way as described in connection with the embodiment in which three gripping devices are used.

The invention also comprises a torque tong in which a pipe, preferably a drill pipe, is to be held and rotated, where the holding function and the positioning of the pipe for rotation is provided by the pipe clamping device as disclosed above.

The pipe clamping device according to the invention provides a simple mechanical positioning and holding of the pipe without it being necessary to use complex control systems (such as electric and hydraulic control systems) to control the positioning of the individual gripping devices that are to hold the pipe. The mechanical positioning and holding of the pipe is provided in that the gripping devices of the pipe clamping device are adapted for synchronous movement forwards towards the pipe.

The pipe clamping device will be capable of being used for pipes of different diameter and the pipe is positioned such that the pipe diameter is received in the tubular centre.

LIST OF FIGURES

The invention will now be described with reference to an example of an embodiment of the invention as shown in the figures, wherein FIG. 1 depicts a first embodiment of the invention, illustrated in the form of a section showing the radial plane of the pipe clamping device 1.

DESCRIPTION OF EMBODIMENTS OF THE INVENTION

Figure 1:
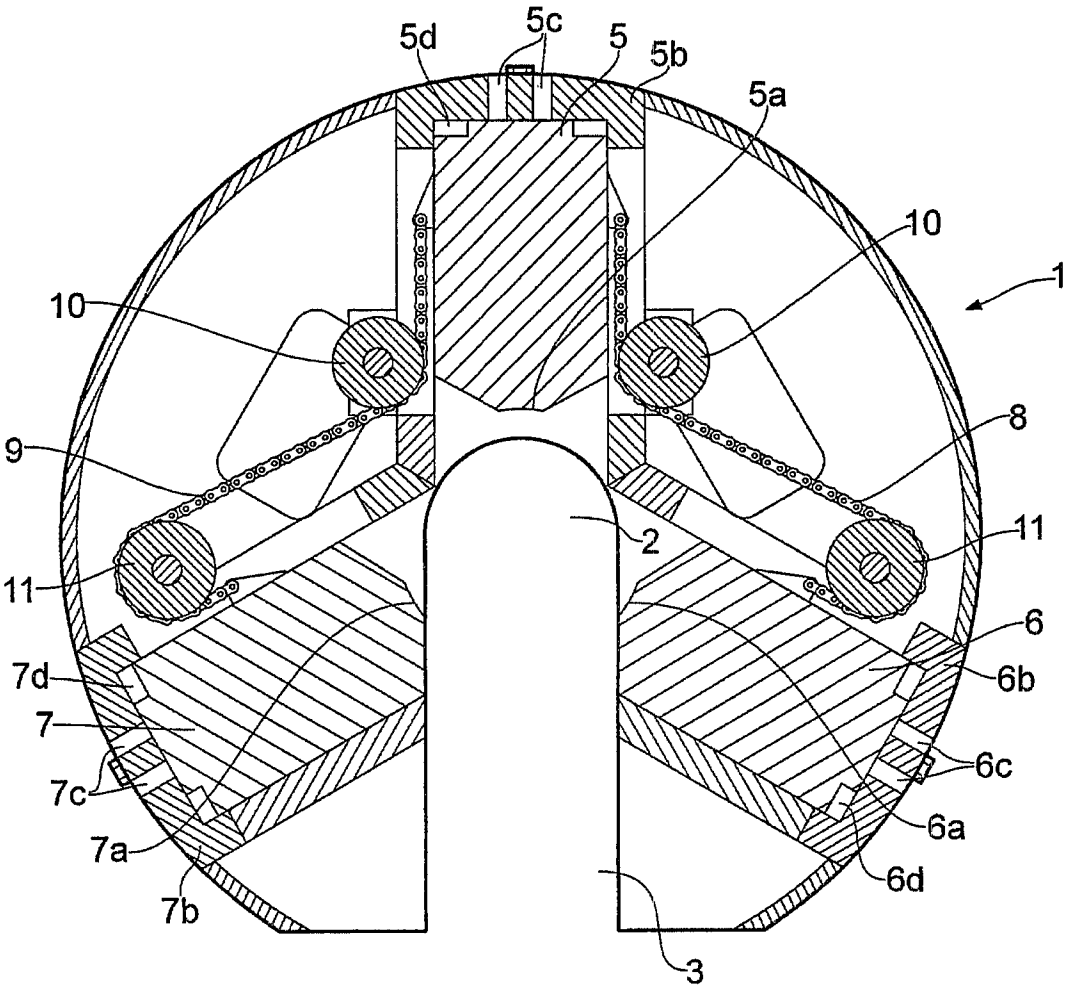

The figures show a tool in the form of a pipe clamping device 1 which, for example, can be used together with a torque tong. The torque tong is to be used for screwing together pipes for use in drilling-related operations. To ensure that the torque tong rotates about its centre, it is necessary that the torque tong should also have a holding function, the pipe being positioned and held in the centre of the torque tong so that the tong is able to turn the pipe that is to be screwed in a way that ensures effective torque transfer. The holding function of the torque tong can be provided by a pipe clamping device such as that described in the attached figures. This pipe clamping device may of course also be used in other connections than for equipment for use in drilling-related operations, where the pipe clamping device ensures that pipes are positioned and held in a predefined area.

The figures show an example of a pipe clamping device 1 where a pipe is to be positioned in a tubular centre in the pipe clamping device housing 1*a*, here shown as a through-opening 2 configured with an insertion portion 3 for insertion of the pipe (not shown in the figures). The pipe is inserted into the insertion portion 3 for reception in the through-opening 2. The axial axis of the pipe will then be oriented essentially perpendicular to the radial plane of the pipe clamping device 1. The through-opening 2 and the insertion portion 3 will be adapted to the size of the pipe diameter that is to be received in the pipe clamping device. The pipe clamping device need not be configured with an insertion portion and, in such an embodiment, can be provided with a pipe permanently received in the tubular centre. In use, the pipe clamping device 1 can be utilised for pipes with different pipe diameter, for example, pipe diameters which vary from 2⅜"-9¼", but a person of skill in the art will understand that the pipe clamping device can be adapted for use of other pipe diameters than the examples mentioned here.

The pipe clamping device 1 is shown here with three gripping devices: a first gripping device 5, a second gripping device 6 and a third gripping device 7 positioned around the tubular centre with gripping jaws 5*a*, 6*a*, 7*a* that are to be moved in against the pipe wall to ensure the correct positioning of the pipe and good force transmission for holding the pipe. Each gripping device is actuated for movement in a radial direction in towards (or out from) the through-opening 3 in which the pipe is placed. In contact with the pipe wall, the individual gripping device provides a holding force which provides the pipe with a stable position in the pipe clamping device 1. In the figures, the gripping devices 5, 6, 7 are configured as pistons, each received in its respective piston housing 5*b*, 6*b*, 7*b*. The gripping devices 5, 6, 7 are pressurised by fluid supply through ducts 5*c*, 6*c*, 7*c*. The individual gripping device will be moved in the piston housing into contact with the pipe wall, where the resistance of the gripping devices against the pipe wall will result in a build-up of pressure in the chambers 5*d*, 6*d*, 7*d* and exertion of a force contribution from the individual gripping device against the pipe for maintaining the position of the pipe.

The pipe clamping device can be adapted in such a way that one or two of the gripping devices are pressurised first and thus it or they are moved first in the direction of the tubular centre. Alternatively, all the gripping devices can be pressurised at the same time.

It is an object of the invention to ensure that the pipe is centred in the tubular centre preferably such that the central axis of the pipe coincides with a pre-selected axial axis of the gripping device 1, preferably the centre axis 1 of the gripping device. To obtain this positioning of the pipe, the pipe clamping device 1 is provided with a system of elongate transmission elements, shown here as first chain 8 and second chain 9 and a pulley system, here shown as first roller means 10 and second roller means 11 for ensuring that the gripping devices move simultaneously into engagement with the pipe.

FIG. 1 shows a first arrangement of the roller means for providing transmission of movement between the gripping devices so as to obtain a synchronised engagement with the pipe. The arrangement shown in this figure is adapted in such a way that the second and third gripping device 6, 7 are pressurised first and draw the first gripping device 5 with them. The first gripping device is pressurised when the pressure in the chambers belonging to the second and third gripping device 6, 7 reaches a certain level. The movements of the second and third gripping devices 6 and 7 are transmitted to the first gripping device 5 as a pulling force by means of the chains 8, 9. The first chain 8 has one end attached to the first gripping device 5 and the second end attached to the second gripping device 6. In this arrangement, the movement of the second gripping device 6 is transmitted to the first gripping device 5 by the chain 8. Furthermore, the second chain 9 has one end attached to the first gripping device 5 and the second end attached to the third gripping device 7 such that the movement of the third gripping device 7 is transmitted to the first gripping device 5.

According to the first embodiment shown in FIG. 1, the first roller means 10 are so positioned that the chains 8, 9 are positioned parallel to the first gripping device 5. The chain portion between the first gripping device 5 and first roller means 10 will thus be given a movement in a direction that coincides with the movement of first gripping device 5, and this configuration provides for effective transmission of pulling force to the first gripping device. The chains 8, 9 are passed onwards from the first roller means 10 to the second roller means 11, each chain being passed substantially a half turn around the second roller means 11 such that the chain at the run-out from the second roller means 11 is directed in a direction that is opposite the direction at the run-in onto the second roller means 11. The chains 8, 9 are passed from the second roller means 11 to attachment on respectively the second and the third gripping device 6, 7. As a result of the chain being deflected such that the movement is given an opposite direction, the chain transmits a movement from the second and third gripping devices 6, 7 to the first gripping device 5 with a movement component which has the opposite direction to the movement of the second and third gripping devices 6, 7. Furthermore, the chain portion between the second roller means 11 and the attachment to the second and third gripping device 6, 7, respectively, is positioned in such a way that the direction of movement of this chain portion coincides with the direction of movement of the second and third gripping device 6, 7.

The arrangement of roller means and chains as shown in FIG. 1 gives an efficient transmission of the movement of the second and third gripping device to the other gripping devices. As one of skill in the art will understand, other locations of the first and second roller means are also conceivable. The roller means can be displaced radially inwards or outwards along the gripping devices. Alternatively, one or both roller means can be located such that the chains 8, 9 are given an angled position in towards the first gripping device and/or the second/third gripping device 6, 7, respectively. In the case where the chain portion that runs between the second/third gripping device and the second roller means has an angled position, the chain movement of the second/third gripping device will be transmitted to the second roller means with a movement component that has a direction which coincides with the direction of movement of the second/third gripping device. In the case where the chain portion that runs from the first roller means to the first gripping device has an angled position, the movement of the chain will be transmitted to the first gripping device with a movement component that has a direction which coincides with the direction of movement of the first gripping device.

Figure 2:
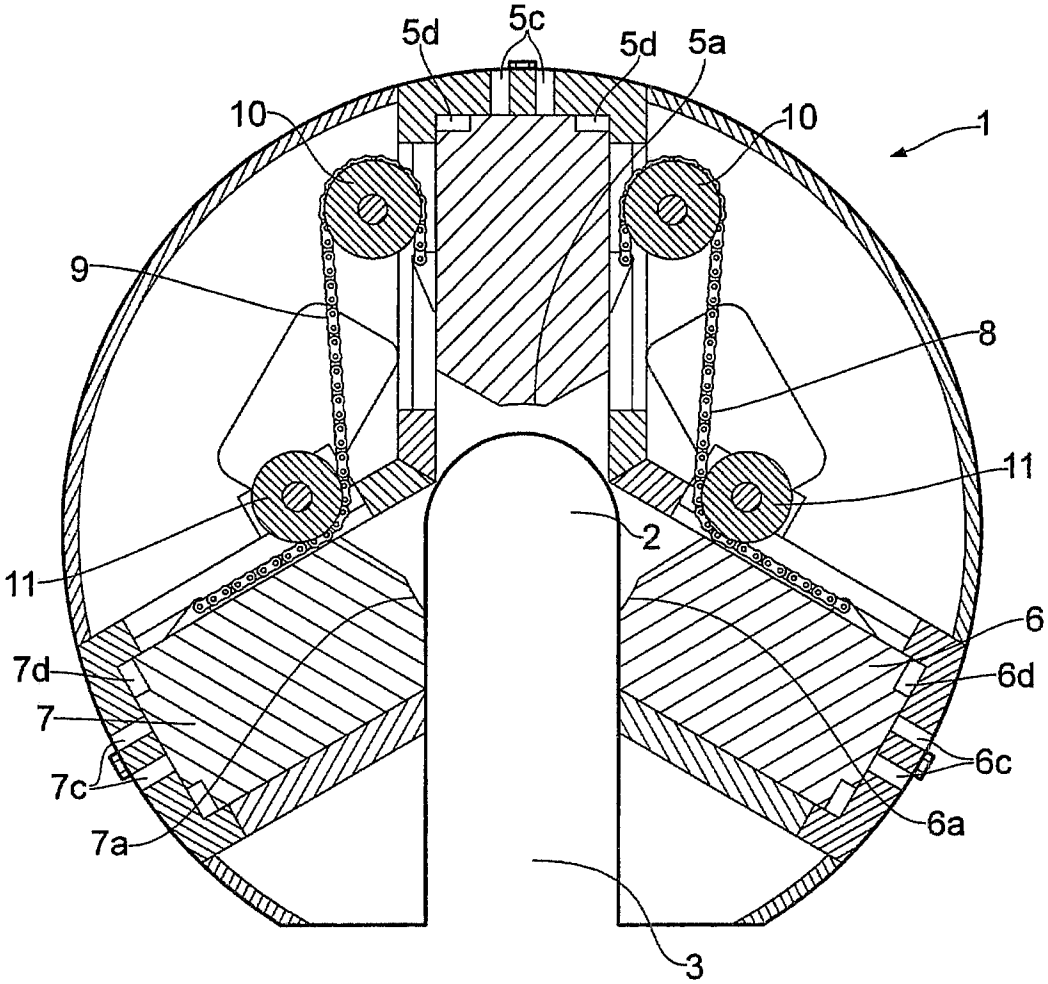
FIG. 2 depicts a second embodiment of the invention, illustrated in the form of a section showing the radial plane of the pipe clamping device 1.

The invention according to the second embodiment is shown in FIG. 2. Here, the first and the second roller means 10, 11 are shown displaced into other positions than those shown in FIG. 1, and the chains 8, 9 run about the roller means 10, 11 in a different way. With the exception of the alternative embodiments for the pipe clamping device 1 that will be described below, the rest of component combination and mode of operation of the pipe clamping device 1 are as described for the first embodiment of the invention as shown in FIG. 1.

The second embodiment that is shown in FIG. 2 is adapted in such a way that the first gripping device 5 is pressurised first and is moved in towards the tubular centre 2, this movement is transmitted by the chains 8, 9 as a pulling force which moves the second and third gripping device 6, 7 in towards the tubular centre. The second and third gripping device 6, 7 are pressurised when the pressure in the chamber belonging to the first gripping device 5 reaches a pre-determined level. According to the second embodiment, the first roller means 10 is positioned in such a way that the chains 8, 9 run parallel to the first gripping device 5 before the run-in onto the first roller means 10. The chain portion between the first gripping device 5 and first roller means 10 will thus be given a movement with a direction that coincides with the movement of the first gripping device 5. The chains 8, 9 are passed around the first roller means 10 by substantially a half turn such that the direction of the chain at the run-out from the first roller means 10 is directed in a direction that is opposite the direction at the run-in onto the first roller means 10. The chains 8, 9 are then passed onwards from the first roller means 10 into contact with the second roller means 11, and thence to attachment to the second and the third gripping device 6, 7, respectively. As a result of the chain being deflected about the first roller means 10 so that the movement is given an opposite direction, the chain transmits a movement to the second and third gripping device 6, 7 with a movement component that has an opposite direction to the movement of the first gripping device 5. Furthermore, the chain portion between the second roller means 11 and the attachment to the second and third gripping device 6, 7, respectively, is positioned in such a way that the direction of movement of this chain portion coincides with the direction of movement of the second and third gripping device 6, 7.

Like the arrangement as shown in FIG. 1, the arrangement as shown in FIG. 2 also provides an efficient transmission of the movement of the first gripping device as a pulling force to the other gripping devices. Here too, a person of skill in the art will understand that other locations of the first and second roller means can be used. The roller means can be displaced radially inwards or outwards along the gripping devices. Alternatively, each of them can be located so that the chains 8, 9 are given an angled position in towards the first gripping device and/or the second/third gripping devices 6, 7, respectively. In the case where the chain portion that runs from the first gripping device towards the first roller means has an angled position, the movement of the first gripping device will be transmitted to the chain with a movement component that has a direction which coincides with the direction of movement of the first gripping device. In the case where the chain portion that runs between the second roller means and the second/third gripping device has an angled position, the chain movement will be transmitted to the second and the third gripping device with a movement component that has a direction which coincides with the direction of movement of the second and the third gripping device.

Figure 3:
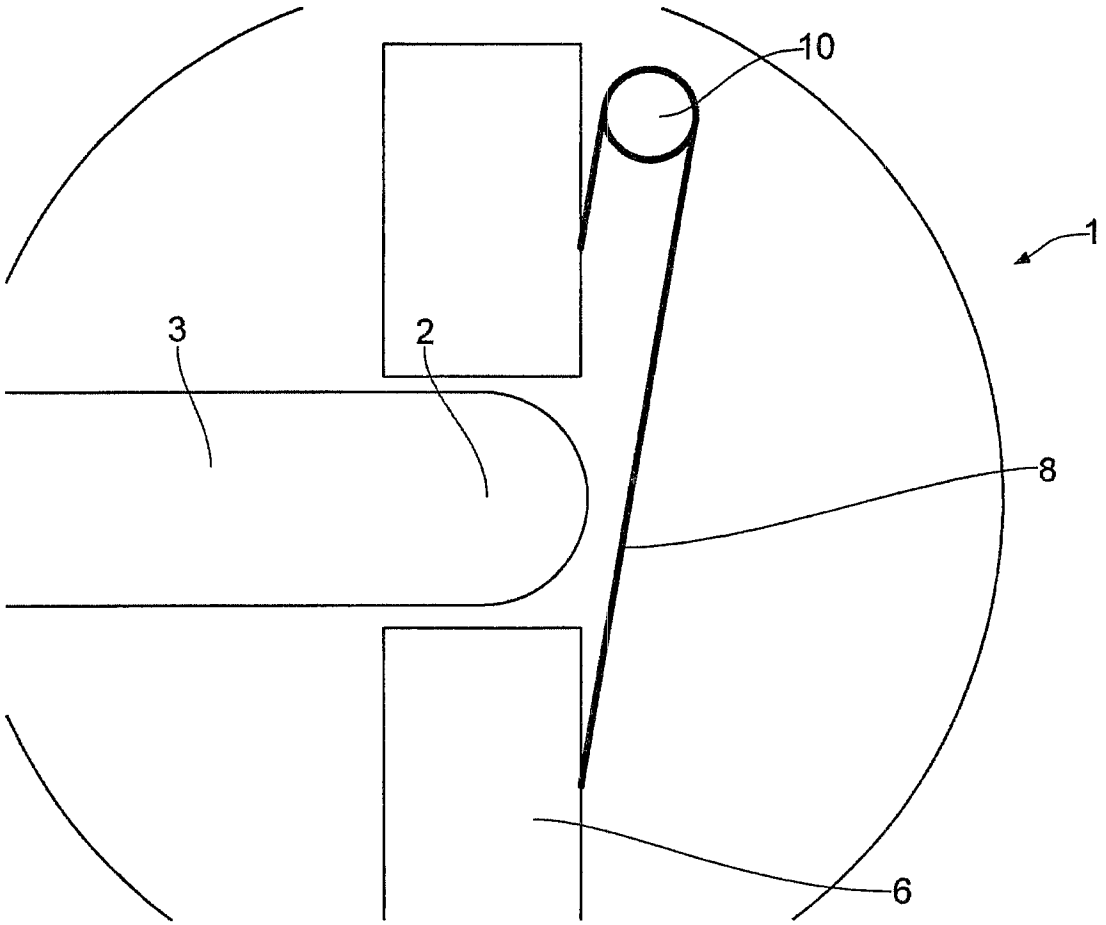
FIG. 3 depicts a third embodiment of the invention, illustrated in the form of a section showing the radial plane of the pipe clamping device 1.
Figure 4:
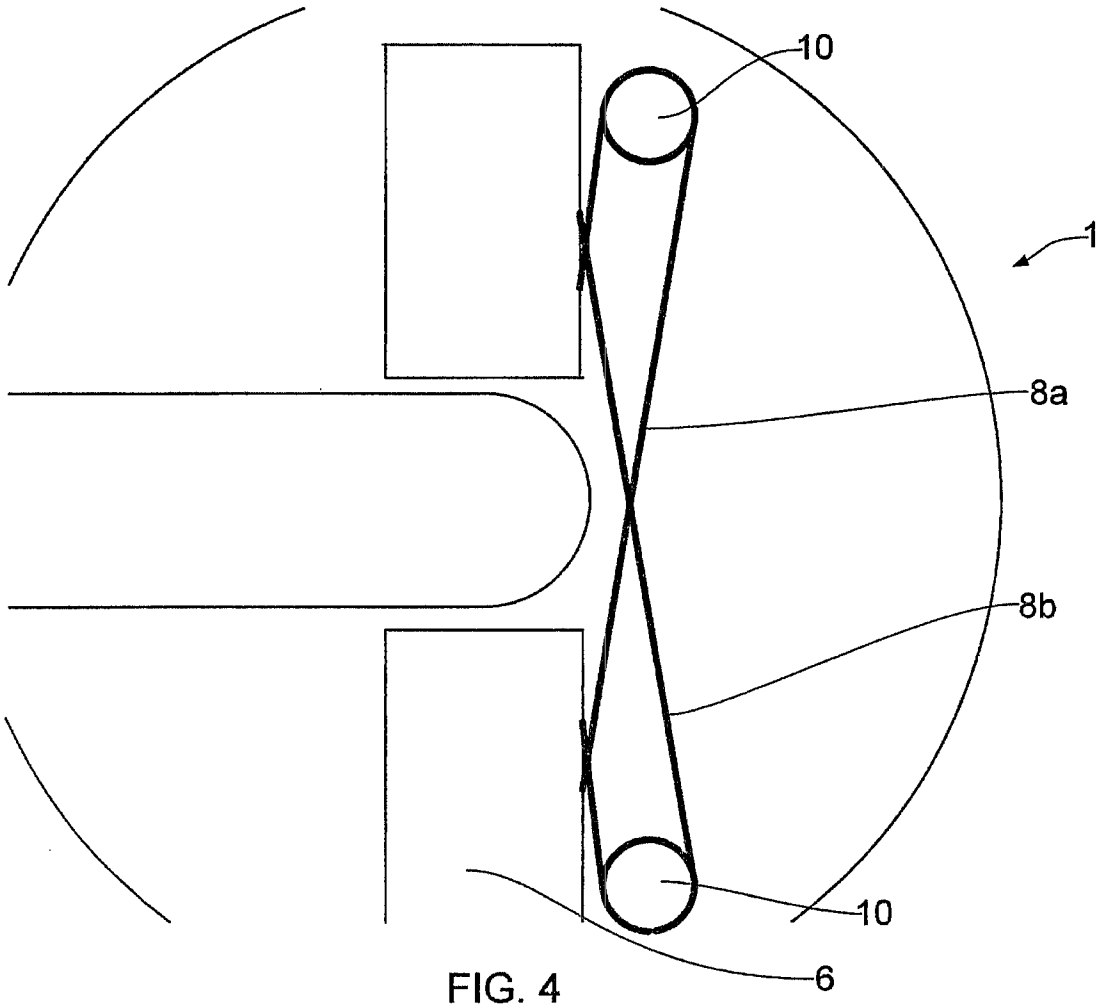
FIG. 4 depicts a fourth embodiment of the invention, illustrated in the form of a section showing the radial plane of the pipe clamping device 1.

In a third embodiment of the pipe clamping device 1 that is shown in FIG. 3, the arrangement comprises two gripping devices, a first roller means 10 and a first chain 8. The first end 8 of the chain is attached to the first gripping device 5 and its second end is attached to the second gripping device 6. Movement of the first gripping device 5 in towards the tubular centre is transmitted as a pulling force in the chain to the second gripping device 6 so as to secure simultaneous movement of the gripping devices 5, 6 in towards the tubular centre 2 similar to that described in connection with the discussion of the other embodiments FIG. 4 shows a fourth embodiment of the pipe clamping device 1, where the pipe clamping device 1, in addition to the set comprising a first roller means 10*a* and a first chain 8*a* as shown in FIG. 3, also further comprises a first roller means 10*b* and a second chain 8*b*. This arrangement allows movement of the first gripping device 5 to be transmitted as a pulling force via the chain 8 to the second gripping device 6 and movement of the second gripping device 5 to be transmitted as a pulling force in the chain 8 to the first gripping device 6. In this way, it is ensured that both gripping devices are given a reciprocal limitation of movement in towards the tubular centre as movement of one of the gripping devices is dependent on the movement of the other gripping device.

Figure 6:
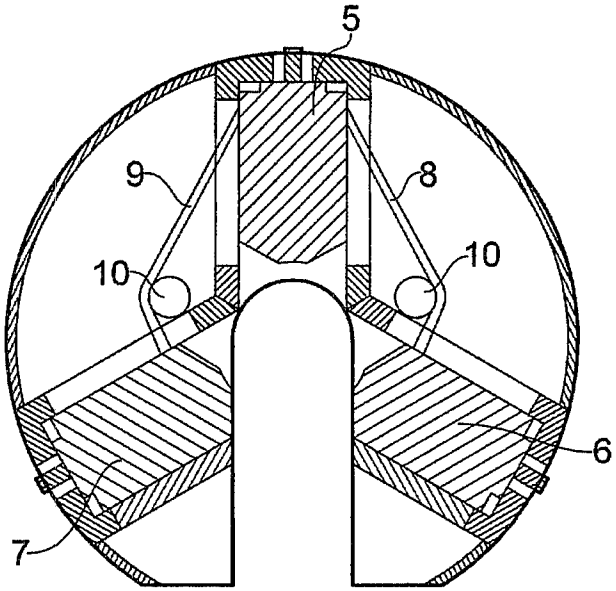
FIG. 6 depicts a sixth embodiment of the invention, illustrated in the form of a section showing the radial plane of the pipe clamping device 1.
Figure 5:
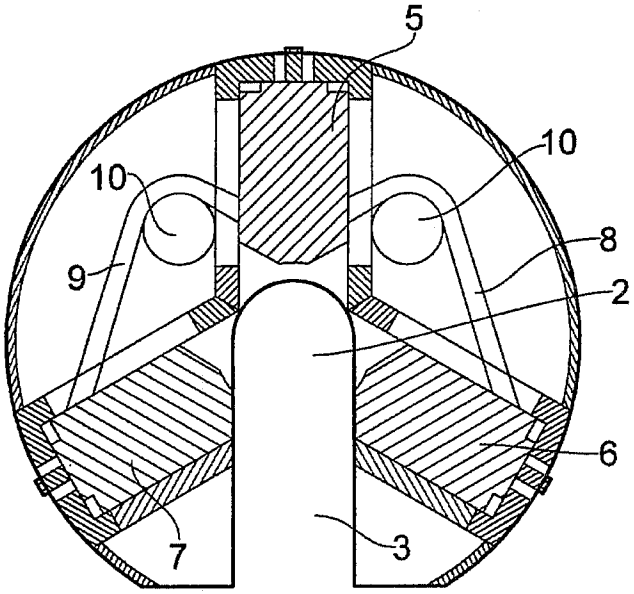
FIG. 5 depicts a fifth embodiment of the invention, illustrated in the form of a section showing the radial plane of the pipe clamping device 1.

In a fifth and sixth embodiment of the pipe clamping device 1 shown respectively in FIG. 5 and FIG. 6, the arrangement comprises three gripping devices 5, 6, 7 and a system of elongate transmission elements, shown here as first chain 8 and second chain 9, and first roller means 10.

The arrangement shown in FIGS. 5 and 6 corresponds to that shown in FIGS. 1 and 2, but according to the fifth and sixth embodiment, only the first roller means 10 are used here. The arrangement of the first roller means 10 and chains 8, 9 as shown in FIG. 5, corresponds to the set-up in FIG. 2, and the arrangement as shown in FIG. 6 corresponds to the set up as shown in FIG. 1, but with the difference that here only first roller means 10 are used.

Since only first roller means 10 are used in the fifth and sixth embodiment, their positioning is crucial for obtaining an efficient transmission of movement between the gripping devices. The positioning of the first roller means 10 as shown in FIG. 5 provides for an efficient transmission of movement between the first gripping device 5 and the other gripping devices 6, 7. The positioning of the first roller means 10 as shown in FIG. 6 gives an efficient transmission of movement from the second and third gripping devices 6, 7 to the first gripping device 5.

Figure 7:
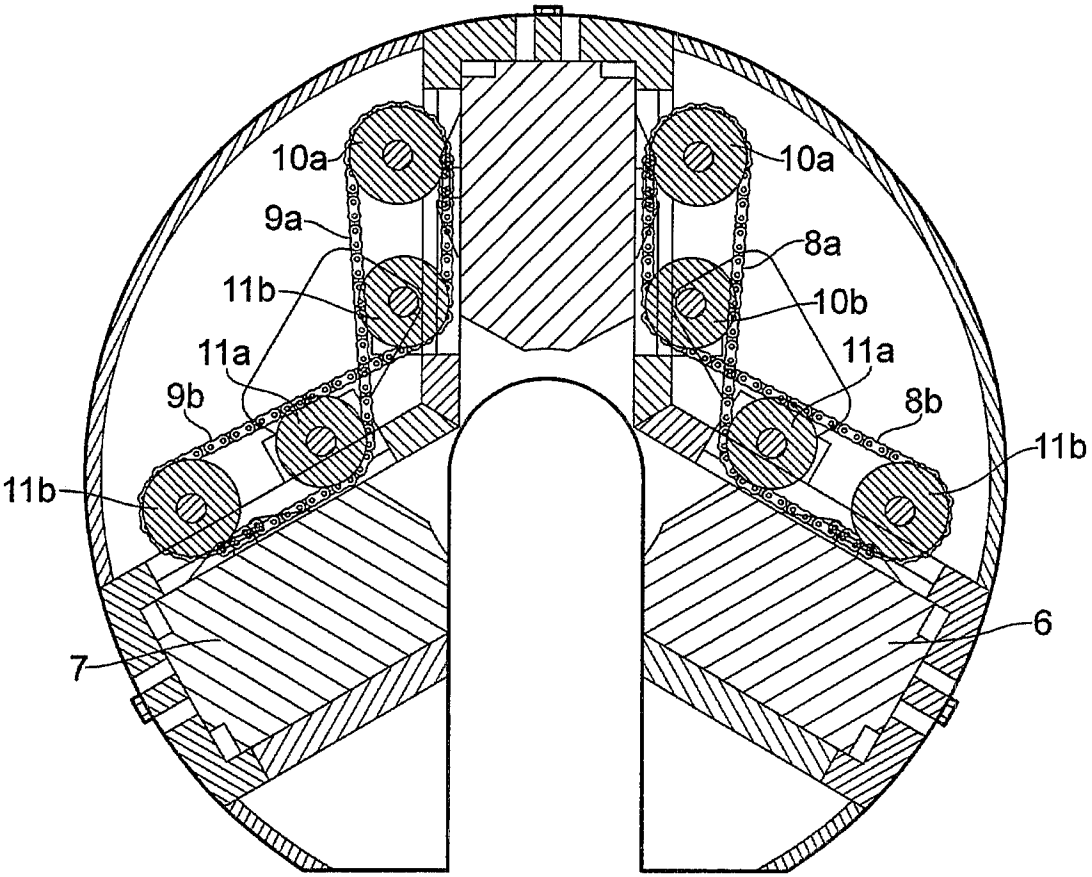
FIG. 7 depicts a seventh embodiment of the invention, illustrated in the form of a section showing the radial plane of the pipe clamping device 1 radial plane.

In order to obtain a synchronised system where the movements of each of the three gripping devices have a reciprocally limiting effect on each other, the invention can be arranged as shown in FIG. 7. This embodiment is a combination of the arrangements shown in FIGS. 1 and 2. The pipe clamping device 1 here is shown provided with two first support means 10*a*, 10*b* on each side of the first gripping device 5 and two second support means 11*a*, 11*b*, respectively, at the second and third gripping devices 6, 7.

The chains 8*a*, 9*a* run from the attachment to the first gripping device 5 over the first support means 10*a* where the direction of travel of the chain is reversed, that is to say that the chain is given a run-out direction from the support means which is oppositely directed to the run-in direction towards the support means, and then to one of the second support means 11*a* which guides the chain to attachment with the second and third gripping device 6, 7, respectively. From the second and third gripping device 6, 7, respectively, the chain 8*b*, 9*b* runs over the second support means 11*b* for reversal of the chain's direction of travel (that is to say that the chain is given a run-out direction from the support means that is oppositely directed to the run-in direction towards the support means) and then to the second of the first support means 10*b* that position the chain 8*b*, 9*b* for attachment to the first gripping device 5. As two chains are used respectively between the first and second gripping device 5, 6 and between the first and third gripping device 6, 7, the arrangement will be self-adjusting for transmission of movement from first gripping device 5 to second gripping device 6, and for transmission of movement from second gripping device 6 to first gripping device 5. The same applies to transmission of movement between first gripping device 5 and third gripping device 7. In this embodiment, all three gripping devices can be equally pressurised.

The embodiments shown in FIGS. 5 and 6, where one support means 10 is used per chain 8, 9, can be combined in the same way as the combination embodiment shown in FIG. 7. This combination also results in a synchronised system where the movements of each of the three gripping devices have a reciprocally limiting effect on each other.

A person of skill in the art will understand that the roller means referred to in the description of these examples can easily be replaced by other support means either of a rotating type or with properties that allow the chains to be passed slidably over/through them, as the support means must be capable of providing a reversal of the chain's direction. This means to say that the chain is given a run-out direction from the support means that is oppositely directed to the run-in direction towards the support means.

As regards the chains 8, 9, they are shown composed of a plurality of links in the two figures. As a person of skill in the art will understand, these too can be replaced by alternative elongate flexible transmission elements which are capable of deflection, such as belts, wire or the like.

Furthermore, the gripping devices are actuated for movement relative to the tubular centre and for provision of force against the pipe wall. In the example described above, the gripping devices are actuated by pressurising chambers, where the fluid for pressurisation may be hydraulic or pneumatic A person of skill in the art will understand that this movement and the force-providing property can be provided by alternative arrangements, for example, electric or pneumatic actuators, or the gripping devices can be actuated by use of a screw device.

When positioning the pipe in the pipe clamping device there is a risk that the pipe may become jammed between the first and second gripping device 5, 6 or between the second and third gripping device 6, 7 or between the first and third gripping device 5, 7.

As the forces that are exerted by the gripping devices are large, the gripping device that is not in engagement can cause substantial damage to the pipe clamping device, and in the worst case cause breakdown when the pipe is incorrectly positioned between two of the gripping devices. To avoid damage and breakdown or failure, the pipe clamping device according to the invention is provided with at least one safety device. FIG. 1 shows two safety devices, each in the form of a spring means 12 which is fastened to the second support means 11. The spring means has an end portion 12*a* which is fastened to the housing 1. This arrangement provides a resilience in the pipe clamping device in that the first support means 10 are arranged so as to be displaceable in a controlled manner.

If the pipe is incorrectly positioned between the first and second gripping device 5, 6 or the first and third gripping device 5, 7, the first and second gripping device 5, 6 or the first and third gripping device 5, 7, respectively, will be brought into engagement with the pipe.

When incorrect positioning of the pipe occurs between the first and second gripping device 5, 6, these gripping devices will be brought into engagement about the pipe, whilst the third gripping device 7 will continue its movement in towards the tubular centre. The third gripping device 7 will continue its movement in towards the tubular centre and will, by means of its movement, draw with it the chain 9. By virtue of the spring means 12, the second support means 11 will be displaced in that the spring means 12 is compressed. The movement of the third gripping device 7 in this case is thus not transmitted to the other gripping devices 5 and 6 but is taken up by the spring means 12 and damaging forces are not exerted on the other components of the pipe clamping device.

When incorrect positioning of the pipe occurs between the first and third gripping device 5, 7, these gripping devices will be brought into engagement about the pipe, whilst the second gripping device 6 will continue its movement in towards the tubular centre. The second gripping device 6 will continue its movement in towards the tubular centre and will, by means of its movement, draw with it the chain 8. By virtue of the spring means 12, the second support means 11 will be displaced in that the spring means 12 is compressed. The movement of the second gripping device 6 in this case is thus not transmitted to the other gripping devices 5 and 7 but is taken up by the spring devices and damaging forces are not exerted on the other components of the pipe clamping device.

If the pipe is incorrectly positioned in an area between the second and the third gripping device 6, 7, these gripping devices will be brought into engagement with the pipe. In this case, the spring means 12 is not compressed when the movement of the second and third gripping device 6, 7 stops after contact with the pipe. Thus, movement is not transmitted from these two gripping devices, and slack occurs in the chain 8 upon movement of the first gripping device 5 in towards the tubular centre. The movement of the first gripping device 5 in towards the tubular centre will thus not result in damaging forces being exerted on the other components of the pipe clamping device.

Figure 9:
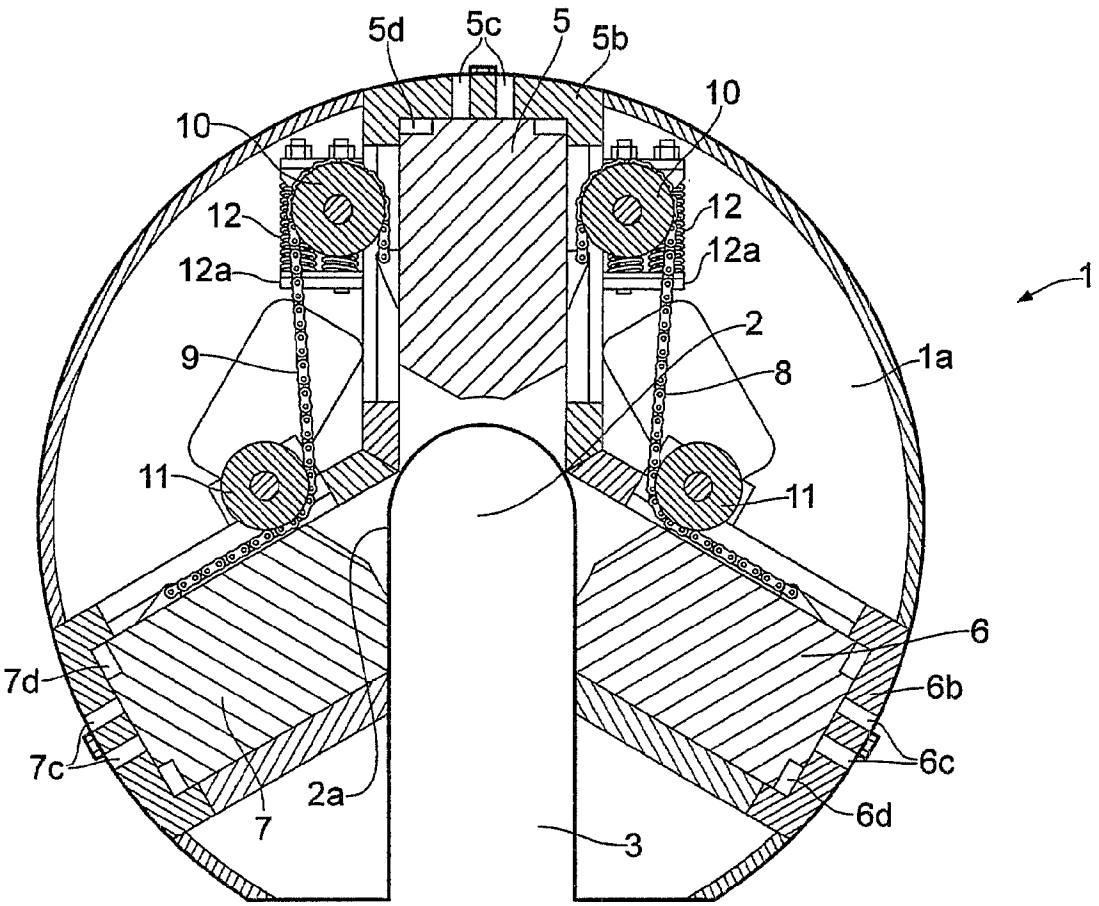
FIG. 9 depicts a second embodiment of a safety device in the second embodiment of the invention according to FIG. 2.
Figure 10:
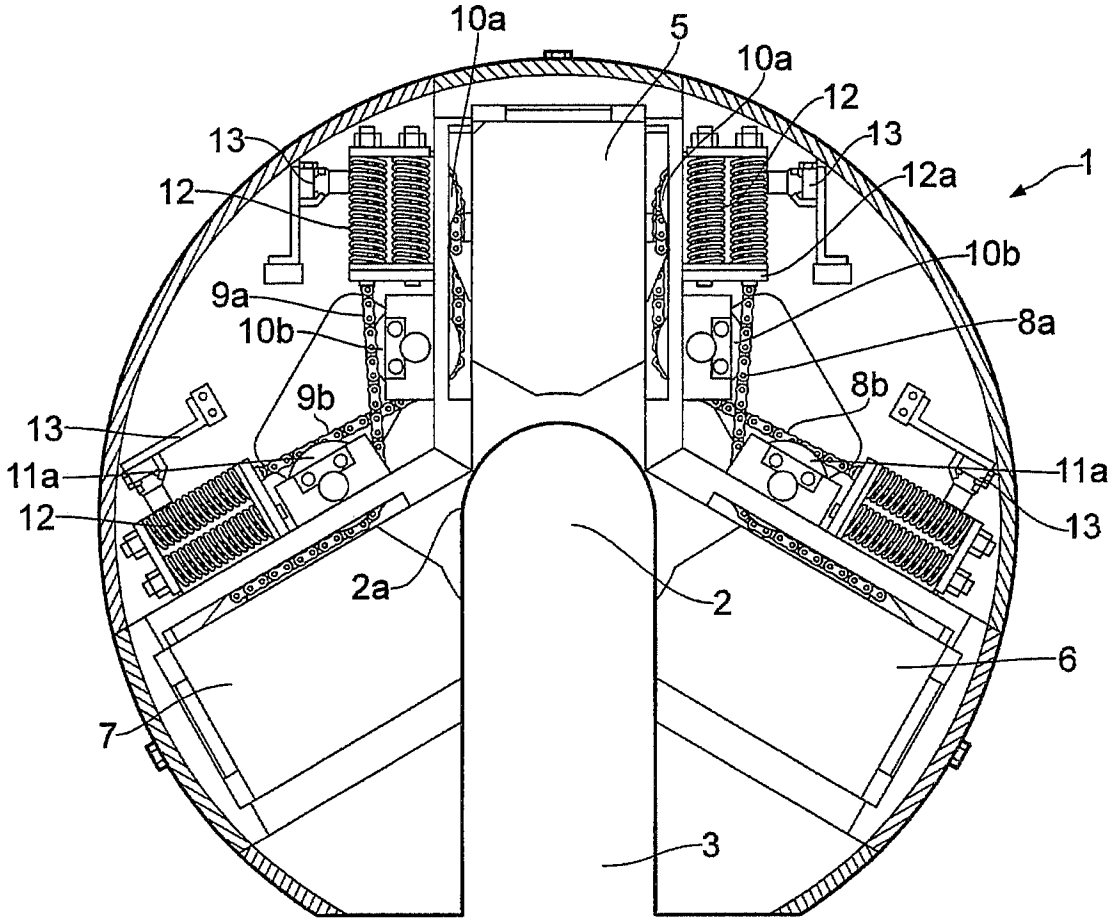
FIG. 10 depicts a third embodiment of a safety device on the seventh embodiment of the invention according to FIG. 7.
Figure 11:
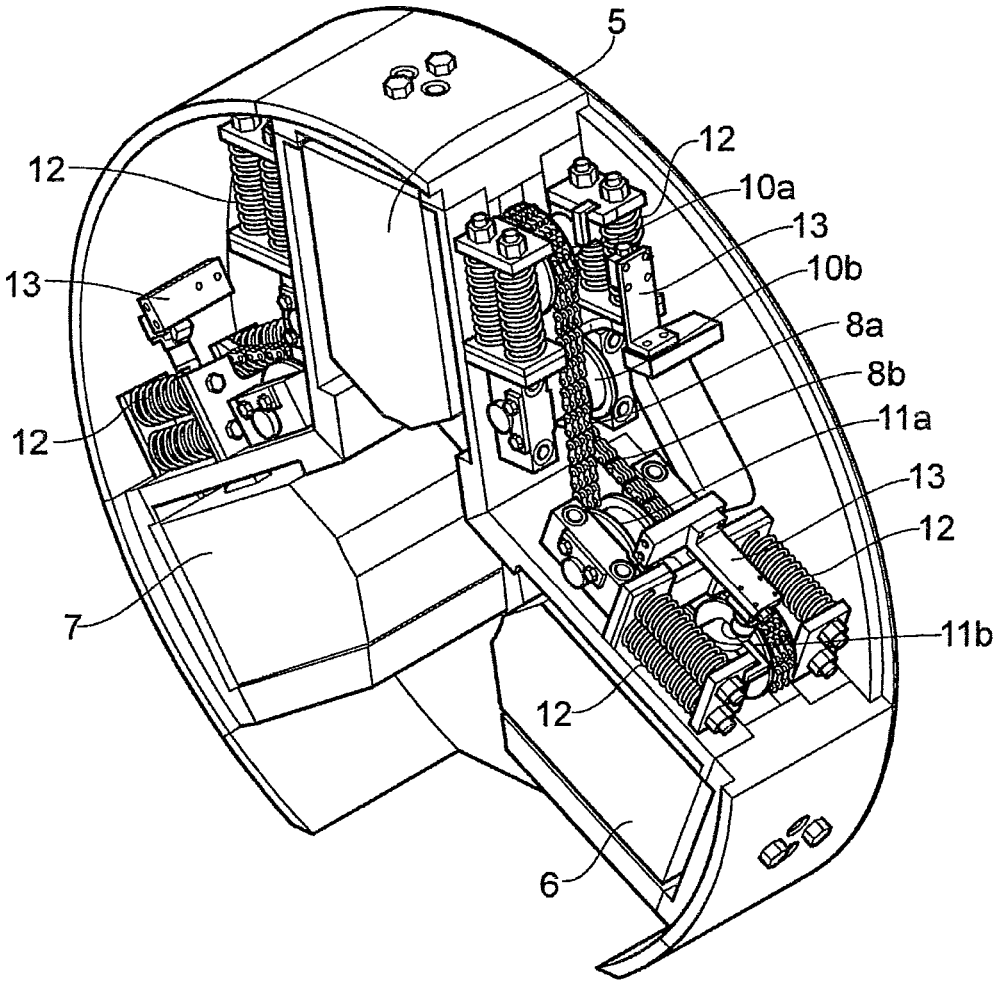
FIG. 11 depicts the same embodiment of the invention as shown in FIG. 10, but illustrated here in the form of a section showing the pipe clamping device in a perspective view.

The invention according to the second embodiment is shown in FIG. 9. Here, the first and the second roller means 10, 11 are shown displaced to positions other than those shown in FIG. 1, and the chains 8, 9 run around the roller means 10, 11 in a different way. With the exception of the alternative embodiments of the pipe clamping device 1 that will be described below, the rest of component combination of the pipe clamping device 1 and its mode of operation are as described in connection with the first embodiment of the invention as shown in FIG. 1.

The second embodiment that is shown in FIG. 9 is adapted in such a way that the first gripping device 5 is pressurised first and is moved in towards the tubular centre 2, and this movement is transmitted by the chains 8, 9 as a pulling force which moves the second and third gripping device 6, 7 in towards the tubular centre. The second and third gripping device 6, 7 are pressurised when the pressure in the chamber belonging to the first gripping device 5 reaches a pre-determined level. According to the second embodiment, the first roller means 10 are so positioned that the chains 8, 9 run parallel to the first gripping device 5 before run-in onto the first roller means 10. The chain portion between the first gripping device 5 and first roller means 10 will thus be given a movement with a direction that coincides with the movement of the first gripping device 5. The chains 8, 9 are passed around the first roller means 10 by substantially a half turn so that the direction of the chain at the run-out from the first roller means 10 is directed in a direction that is opposite to the direction at the run-in onto the first roller means 10. The chains 8, 9 are passed onwards from the first roller means 10 into contact with the second roller means 11, and thence to attachment on the second and the third gripping device 6, 7, respectively. As a result of the chain being deflected around the first roller means 10 such that the movement is given an opposite direction, the chain transmits a movement to the second and third gripping device 6, 7 with a movement component that has an opposite direction to the movement of the first gripping device 5. Furthermore, the chain portion between the second roller means 11 and the attachment to the second and third gripping device 6, 7, respectively, is positioned in such a way that the direction of movement of this chain portion coincides with the direction of movement of the second and third gripping devices 6, 7.

Figure 8:
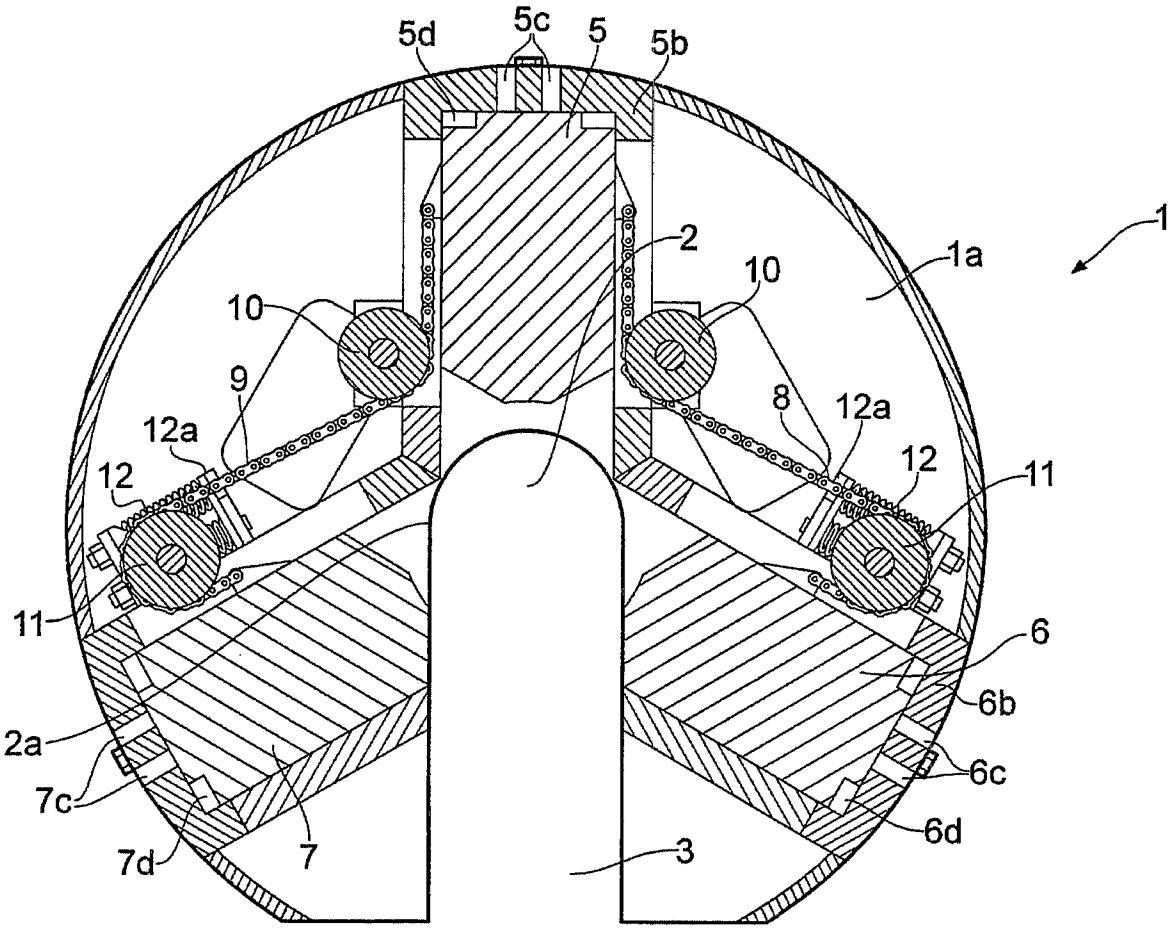
FIG. 8 depicts a first embodiment of a safety device in the first embodiment of the invention according to FIG. 1.

Like the arrangement as shown in FIG. 8, the arrangement shown in FIG. 9 also provides an efficient transmission of the movement of the first gripping device as a pulling force to the other gripping devices. Here too, a person of skill in the art will understand that other locations of the first and second roller means can be used. The roller means can be displaced radially inwards or outwards along the gripping devices. Alternatively, each of them can be located so that the chains 8, 9 are given an angled position in towards the first gripping device and/or the second/third gripping device 6, 7, respectively. In the case where the chain portion that runs from the first gripping device towards the first roller means has an angled position, the movement of the first gripping device will be transmitted to the chain with a movement component that has a direction which coincides with the direction of movement of the first gripping device. In the case where the chain portion that runs between the second roller means and the second/third gripping device has an angled position, the chain movement will be transmitted to the second and the third gripping device with a movement component which has a direction that coincides with the direction of movement of the second and the third gripping devices.

In FIG. 2 the two safety devices in the form of a spring means 12 are shown fastened to the first support means 10. The spring means has an end portion 12*a* which is fastened to the housing 1. This arrangement provides a resilience in the pipe clamping device in that the first support means 10 are arranged to be displaceable in a controlled manner. The mode of operation for this arrangement is like that described in the discussion of FIG. 1.

If the pipe is incorrectly positioned in an area between the second and the third gripping device 6, 7, these gripping devices will be brought into engagement with the pipe. The first gripping device 5 will continue its movement in a direction inwards towards the tubular centre and, by means of its movement, will draw with it the chains 8, 9. By virtue of the spring means 12, the first support means 10 will be displaced in that the spring means 12 is compressed. The movement of the first gripping device 5 in this case is thus not transmitted to the other gripping devices 6 and 7 but is taken up by the spring means 12 and destructive forces are not exerted on the other components of the pipe clamping device.

If the pipe is incorrectly positioned between the first and second gripping device 5, 6 or the first and third gripping device 5, 7, the first and second gripping device 5, 6 or the first and third gripping device 5, 7, respectively, will be brought into engagement with the pipe.

When incorrect positioning of the pipe occurs between the first and second gripping device 5, 6, these gripping devices will be brought into engagement about the pipe. In this case, the spring means 12 is not compressed when the movement of the first and the second gripping device 5, 6 stops after contact with the pipe. Movement is thus not transmitted from these two gripping devices, and slack occurs in the chain 9 upon movement of the third gripping device 7 in towards the tubular centre. The movement of the third gripping device 7 in towards the tubular centre will thus not result in damaging forces being exerted on the other components of the pipe clamping device.

When incorrect positioning of the pipe occurs between the first and third gripping device 5, 7, these gripping devices will be brought into engagement about the pipe, whilst the second gripping device 6 will continue its movement in towards the tubular centre. In this case, the spring means 12 is not compressed when the movement of the first and the third gripping device 5, 7 stops after contact with the pipe. Thus, movement is not transmitted from these two gripping devices, and slack occurs in the chain 8 upon movement of the second gripping device 6 in towards the tubular centre. The movement of the second gripping device 6 in towards the tubular centre will thus not result in damaging forces being exerted on the other components of the pipe clamping device.

FIGS. 3 and 4 show a self-adjusting non-destructive arrangement provided with safety devices in the form of spring means 12 to prevent damage to the system. The arrangement can also be adapted to detect whether a pipe is positioned outside the tolerance zone that is defined for the tubular centre. The system is a combination of the embodiments shown in FIGS. 1 and 2. The pipe clamping device 1 is shown here provided with two first support means 10*a*, 10*b* on each side of the first gripping device 5 and two second support means 11*a*, 11*b* respectively by the second and third gripping device 6, 7. First and second support means 10*a*, 10*b*, 11*a*, 11*b* are provided with safety devices in the form of spring means 12 fastened to the support means. The spring means 12 have an end portion 12*a* fastened to the housing 1.

The chains 8*a*, 9*a* run from an attachment with the first gripping device 5 over one of the first support means 10*a* where the direction of travel of the chain is reversed, that is to say that the chain is given a run-out direction from the support means that is oppositely directed to the run-in direction towards the support means, and then to one of the second support means 11*a* which guides the chain to attachment with the second and third gripping device 6, 7, respectively. From the second and third gripping device 6, 7, respectively, the chain 8*b*, 9*b* runs over the second of the second support means 11*b* for reversing the direction of travel of the chain (that is to say that the chain is given a run-out direction from the support means that is oppositely directed to the run-in direction towards the support means) and then to the second of the first support means 10*b* which positions the chain 8*b*, 9*b* for attachment to the first gripping device 5. Since two chains are used between the first and second gripping devices 5, 6 and between the first and third gripping devices 6, 7, the arrangement will be self-adjusting for transmission of movement from the first gripping device 5 to the second gripping device 6 and for transmission of movement from the second gripping device 6 to the first gripping device 5. The same applies to transmission of movement between the first gripping device 5 and the third gripping device 7. In this embodiment all three gripping devices can be equally pressurised.

In the example illustrated in FIGS. 3 and 4, the pipe clamping device is shown equipped with sensor devices for the detection of the positional displacement of the support means, but this arrangement will of course function equally well without these sensor devices 13. The following description of the mode of operation of this pipe clamping device, as regards which support means are displaced and which spring means are compressed will, as understood by one of skill in the art, also apply to the case where sensor devices are not used. Switch or sensor devices 13 are located on each of the spring means 12 to detect displacement of the support means, as is shown in the example where it is the compression of the spring means that is detected. Detection of displacement, here spring compression, is transmitted as a signal to a switch so that information can be given indicating that the pipe is outside the tolerance zone of the tubular centre and indicating which of the gripping devices are not in engagement with the pipe. The system can then be arranged so that the sequence can be interrupted. A person of skill in the art will understand that switch and sensor devices 13 can be adapted for detection of displacement of other types of safety devices than spring device 12 as described here; furthermore, switch and sensor devices 13 can be adapted in such a way that it is the displacement of the support means that is detected.

If the pipe is incorrectly positioned outside the tolerance zone of the tubular centre in an area between the second and the third gripping device 6, 7, these gripping devices will be brought into engagement with the pipe. The first gripping device 5 will continue its movement in the direction of the tubular centre and, by means of its movement, will draw with it the chains 8*a*, 9*a*. The first support means 10*a* on each side of the first gripping device 5 are displaced in that the spring means 12 are compressed. Since the pipe clamping device according to this embodiment is equipped with sensor devices 13, this compression will be detected by the sensor device 13 which sends a signal to a switch indicating that the first gripping device 5 is not in engagement with the pipe.

Similarly, if the pipe is incorrectly positioned outside the tolerance zone of the tubular centre in an area between the first and the third gripping device 5, 7, these gripping devices will be brought into engagement with the pipe. The second gripping device 6 will continue its movement in towards the tubular centre and, by means of its movement, will draw with it the chain 8*b*. By virtue of the spring means 12, the second support means 11*b* will be displaced in that the spring means 12 are compressed. Since the pipe clamping device according this embodiment is equipped with sensor devices 13, this compression will be detected by the sensor 13 which sends a signal to a switch indicating that the second gripping device 6 is not in engagement with the pipe.

If the pipe is incorrectly positioned outside the tolerance zone of the tubular centre in an area between the first and the second gripping device 5, 6, these gripping devices will be brought into engagement with the pipe. The third gripping device 7 will continue its movement in towards the tubular centre and, by means of its movement, will draw with it the chain 9*b*. By virtue of the spring means 12, the second support means 11*b* will be displaced in that the spring means 12 are compressed. Since the pipe clamping device according this embodiment is equipped with sensor devices 13, this compression will be detected by the sensor 13 which sends a signal to a switch indicating that the third gripping device 7 is not in engagement with the pipe.

A person of skill in the art will understand that it is also possible to use the arrangement without employing sensor/switch devices 13, a fully synchronised arrangement then being obtained where the spring means ensure that breakdown or failure of the other components of the pipe clamping device is avoided, in that the spring means are compressed when the pipe is incorrectly positioned outside the tubular centre and is jammed between two gripping devices.

The safety device that is described in the above examples is shown in the form of a spring means 12 where two springs are fastened to a bracket at the end portion 12*a* of the spring means that is fastened to the housing 1*a*. Two spring means 12 may be arranged on each side of the first or second support means according to the examples shown in FIGS. 1 and 2, and on each side of the first and second support means according to the example as shown in FIGS. 3 and 4. As one of skill in the art will understand, these are merely examples of arrangements in which the spring device is included.

The skilled person will further understand that the safety device can also be provided by means of other devices, the essential point being that the safety device is capable of exerting a controlled displacement. The safety device must have a resilience in order to obtain displacement. Control of the displacement is provided in that this resilience must be adjustable so that the device provides a certain resistance to movement until the device is loaded with a load/force that exceeds a predetermined value. The support means to which the safety device is connected is allowed to move or shift when this pre-determined value is exceeded. As the skilled person will understand, this can be achieved in that the device has a certain stiffness. As examples of devices that satisfy these criteria mention may be made of a means that is compressible and which has elastic properties, as for example a spring means. Alternatively, a pressure-controlled piston cylinder can be used, either of a pneumatic or hydraulic type, to provide a controlled stiffness and the possibility of movement of at least one of the support means. The length of stroke of the safety device may, for example, be equivalent to half of the length of stroke of the gripping devices, the chains being fastened to one end of the gripping device when the safety device starts the displacement of the support means. There will then be a 2.1 ratio between the stroke of the gripping device and the safety device respectively It should also be mentioned that use of a safety device as described here can be used in an embodiment like that shown in FIGS. 1-4, where instead of two support means only one support means 10 per chain 8, 9 is used. An embodiment of the invention which employs two gripping devices and one support means equipped with a safety device and one or two chains is also conceivable.

One of skill in the art will understand that the roller means referred to in the description of these examples can easily be replaced by other support means either of a rotating type or having properties that allow the chains to be passed slidably over/through them, as the support means must be capable of providing a reversal of the direction of the chain. That is to say that the chain is given a run-out direction from the support means which is oppositely directed to the run-in direction towards the support means.

With regard to the chains 8, 9, they are composed of a plurality of links in the two figures. As one of skill in the art will understand, they may also be replaced by alternative elongate flexible transmission elements that are capable of being deflected, such as belts, wire or the like.

Furthermore, the gripping devices are actuated for movement relative to the tubular centre and for providing force against the pipe wall. In the example described above, the gripping devices are actuated by pressurising chambers, where the fluid for pressurisation may be hydraulic or pneumatic. A person of skill in the art will understand that this movement and the force-providing property can be provided by alternative arrangements, for example, electric or pneumatic actuators, or the gripping devices can be actuated by using of screw device.

It should be stressed that although the safety device is described in connection with a pipe clamping device, it may also be used in other connections where at least one of a first and second support means is to be supported and where an elongate flexible transmission element runs over first and second support means, the elongate flexible element connecting a first and a second gripping device and transmitting movement between them. The safety device is then arranged so that the support means it supports can be displaced controllably if movement of one of the gripping devices is prevented.

The invention claimed is:

1. A pipe clamping device comprising a housing which has a tubular centre in which a pipe is to be positioned, the pipe clamping device comprising:

at least three gripping devices for synchronous movement in towards the pipe, each gripping device being disposed with a direction of movement in towards the tubular centre, wherein each gripping device is arranged in order, in contact with the pipe, to provide a holding force;

at least two elongate flexible transmission elements for the gripping devices, each of the at least two elongate flexible transmission elements being attached to one of the gripping devices and running in contact with at least one supporting element, each of the at least two elongated flexible transmission elements further being attached to one of the rest gripping devices, such that one of the at least three gripping devices is attached to both of the at least two elongate flexible transmission elements, while each of the remaining gripping devices are connected to one of the elongate flexible transmission elements, and upon movement of at least one of the gripping devices, this movement is transmitted to at least one of the other gripping devices via the associated elongate transmission element.

2. The pipe clamping device according to claim 1, wherein the movement of the at least one gripping device is transmitted via the elongate flexible transmission elements as a pulling force to each of the other gripping devices.

3. The pipe clamping device according to claim 1, wherein a set comprising two elongate flexible transmission elements, where each elongate flexible transmission element is in contact with at least one supporting element, is arranged so that each set runs from attachment to one of the gripping devices to each of the other gripping devices.

4. The pipe clamping device according to claim 1, wherein at least one of the elongate flexible transmission elements runs from one of the gripping devices and in contact with two supporting elements before attachment to each of the other gripping devices.

5. The pipe clamping device according to claim 1, wherein the at least one supporting element is disposed so that the run-out direction of the elongate flexible transmission element from this supporting element is oppositely directed to the run-in direction towards this supporting element.

6. The pipe clamping device according to claim 1, wherein the at least one supporting element positions the end portion of each belt towards attachment to the gripping devices.

7. The pipe clamping device according to claim 1, wherein the elongate flexible transmission element is given a change in direction by contact with the at least one supporting element, thereby giving the elongate flexible transmission element a movement for transmission to each of the other gripping devices with a movement component that is oppositely directed to the movement of the at least one gripping device.

8. The pipe clamping device according to claim 1, wherein each of the gripping devices is equipped with a device configured to provide movement in towards the tubular centre and generating holding force in contact with the pipe.

9. The pipe clamping device according to claim 1, wherein that the gripping devices are actuated by a force-providing device, the force-providing device being linear actuators.

10. The pipe clamping device according to claim 1, wherein the at least one supporting element is positioned in such a way that a movement component of the movement of the elongate flexible transmission element is transmitted to each of the other gripping devices in a direction that coincides with the direction of movement thereof.

11. The pipe clamping device according to claim 1, wherein the at least one supporting element is positioned so that the movement of the elongate flexible transmission element is transmitted to each of the other gripping devices in a direction that coincides with the direction of movement thereof.

12. The pipe clamping device according to claim 1, wherein the at least one supporting element is a roller.

13. The pipe clamping device according to claim 1, wherein the at least one supporting element being connected to at least one safety device for controlled displacement of this supporting element.

14. The pipe clamping device according to claim 13, wherein the at least one safety device has a portion that is fastened to the pipe clamping device housing.

15. The pipe clamping device according to claim 13, wherein the movement of the at least one gripping device is transmitted by the elongate flexible transmission elements as a pulling force to each of the other gripping devices.

16. The pipe clamping device according to claim 13, wherein a set comprising two elongate flexible transmission elements, where each elongate flexible transmission element is in contact with at least one supporting element, is arranged so that each set runs from attachment to one of the gripping devices to each of the other gripping devices, such that a gripping device is attached to the two elongate flexible transmission elements, while each of the remaining gripping devices are connected to one of the elongate flexible transmission elements.

17. The pipe clamping device according to claim 13, wherein at least one of the elongate flexible transmission elements runs from one of the gripping devices and in contact with two supporting elements before attachment to each of the other gripping devices.

18. The pipe clamping device according to claim 13, wherein the elongate flexible transmission element is given a change in direction upon contact with the at least one supporting element so that the elongate flexible transmission element is given a movement for transmission to each of the other gripping devices with a movement component that is oppositely directed to the movement of the at least one gripping device.

19. The pipe clamping device according to claim 13, wherein the at least one safety device comprises a compressible elastic element.

20. The pipe clamping device according to claim 13, wherein the at least one safety device comprises a spring.

21. The pipe clamping device according to claim 13, wherein the at least one safety device comprises a pressure-controlled piston cylinder.

22. The pipe clamping device according to claim 13, wherein the pipe clamping device further comprises a detection device comprising at least one safety device and at least one sensor device, where the at least one supporting element is connected to the at least one safety device, the at least one safety device being provided with the at least one sensor device, which is arranged to detect the displacement of the supporting element.

23. The pipe clamping device according to claim 22, wherein the sensor device is connected to a switch.

24. The pipe clamping device according to claim 13, wherein the safety device supports at least one supporting element, where at least one elongate flexible transmission element runs over the at least one supporting element, the at least one elongate flexible transmission element connecting a first and a second gripping device and transmitting movement between them, wherein the safety device is arranged in such a way that the supporting element it supports can be displaced controllably if movement of one of the gripping devices is prevented.

* * * * *